US005390958A

United States Patent [19]

Soo

[11] Patent Number: 5,390,958

[45] Date of Patent: Feb. 21, 1995

[54] TRACK/ROLLER SKATE

[76] Inventor: Mike Soo, No. 403, Chung Shan Rd., Jen Teh Hsiang, Tainan Hsien, Taiwan, Prov. of China

[21] Appl. No.: 117,254

[22] Filed: Sep. 3, 1993

[51] Int. Cl.[6] ..... A63C 17/10

[52] U.S. Cl. ..... 280/844; 280/11.27; 280/11.28

[58] Field of Search ..... 280/842, 844, 11.19, 280/11.27, 87.041, 87.042, 11.28

[56] References Cited

U.S. PATENT DOCUMENTS 4,337,961 7/1982 Covert et al. ..... 280/844

*Primary Examiner*—Richard M. Camby

*Attorney, Agent, or Firm*—Holland & Hart; Ralph F. Crandell

[57] ABSTRACT

A track/roller skate includes an upper structure, front and rear roller assemblies mounted below the upper structure and including a plurality of rollers aligned in two lines, a device for mounting the roller assemblies to the upper structure, and a track removably mounted to surround each roller line to move therewith.

2 Claims, 5 Drawing Sheets

TRACK/ROLLER SKATE

BACKGROUND OF THE INVENTION

1. Field of the Invention

The present invention relates to a novel structure which allows skating and grass skiing.

2. Description of Related Art

Skating and grass skiing both are popular sports and, people who enjoy one of them often also enjoy the other. Though the footwear for both sports are similar, the users still have to buy two different kinds of footwear, causing an additional expense. Therefore, there has been a long and unfulfilled need for a sports wearing which can be used to either skating or grass skiing.

SUMMARY OF THE INVENTION

The present invention provides a track/roller skate which includes an upper structure, a roller means mounted below the upper structure and including a plurality of rollers aligned in two lines, means for mounting the roller means to the upper structure, and a track removably mounted to surround each roller line to move therewith.

In accordance with one aspect of the invention, each roller includes a plurality of transverse corrugations on an outer periphery thereof.

In accordance with another aspect of the invention, each roller includes a plurality of transverse elongate slots in a periphery thereof.

Other objects, advantages, and novel features of the invention will become more apparent from the following detailed description when taken in conjunction with the accompanying drawings.

DESCRIPTION OF THE PREFERRED EMBODIMENTS

Figure 1:
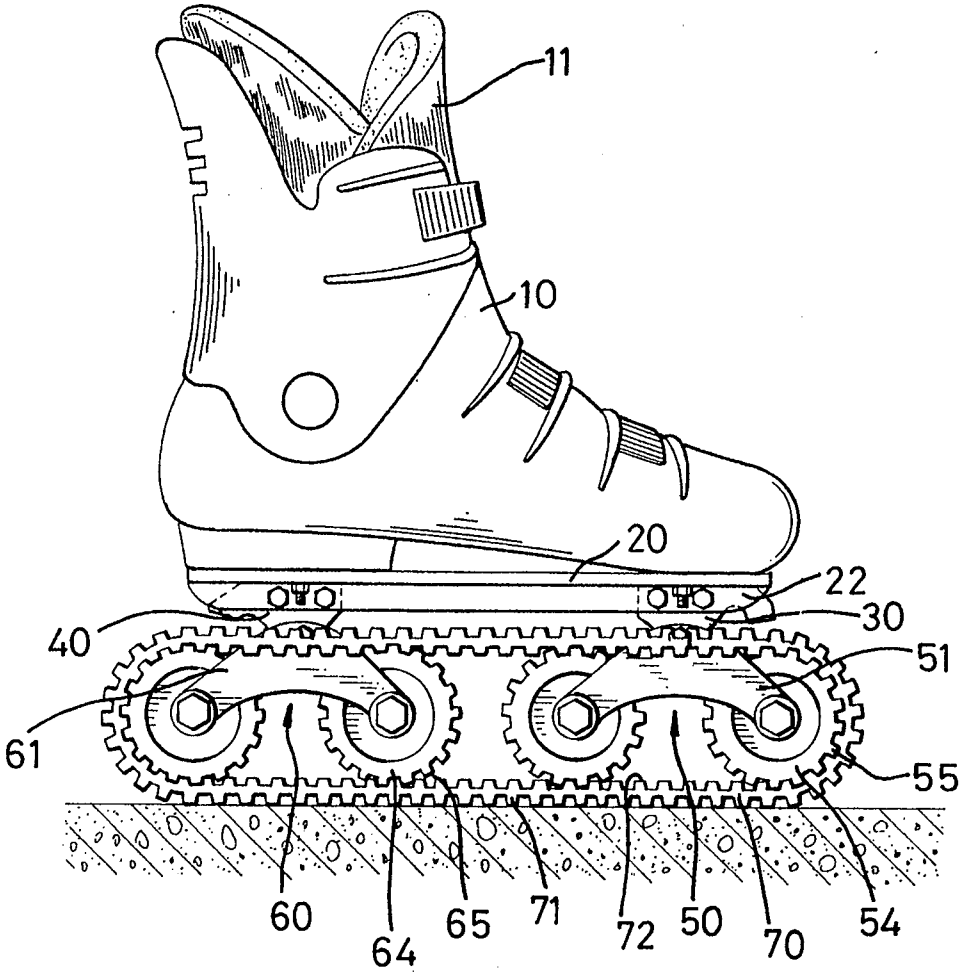
FIG. 1 is a side view of a track/roller skate in accordance with the present invention.
Figure 2:
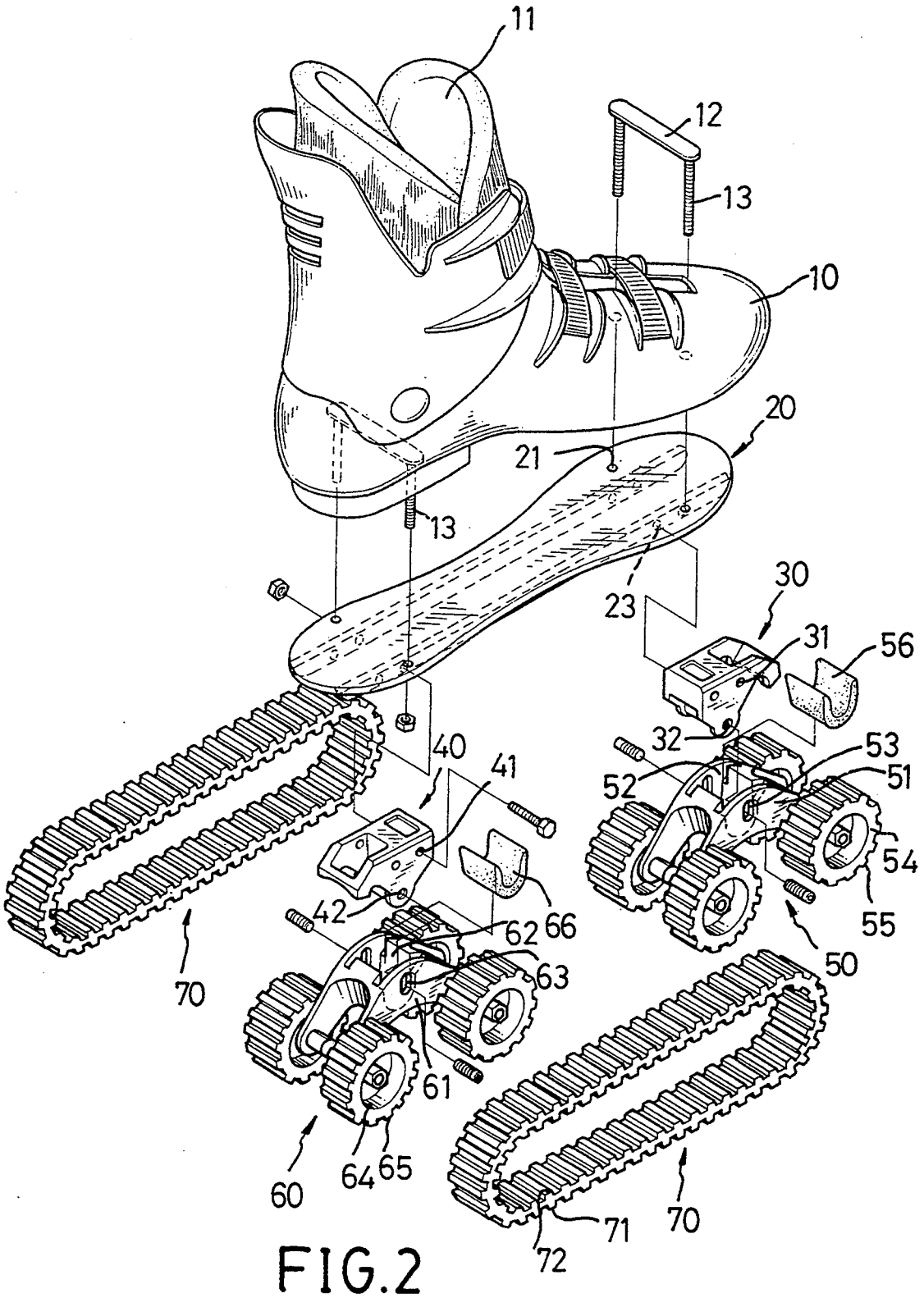
FIG. 2 is an exploded view of the track/roller skate in FIG. 1.

Referring to the drawing and particularly to FIGS. 1 through 4, a track/roller skate in accordance with the present invention includes an upper structure (such as a skate boot 10), front and rear roller assemblies 50 and 60 mounted below the skate boot 10 and including a plurality of rollers 54 and 64 aligned in two lines, means for mounting the roller assemblies 50 and 60 to an underside of the skate boot 10, and a track 70 removably mounted to surround each roller line to move therewith.

In this embodiment, the mounting means includes a plate 20 having a configuration substantially conforming with the bottom of the skate boot 10 and having two pairs of holes 21 respectively formed in front and rear sections thereof. Two parallel mounting ribs 22 project downward from an underside of the plate 20 and extend along the longitudinal direction of the plate 20. A pair of transverse holes 23 are formed in each of front and rear sections of each mounting rib 22.

Figure 3:
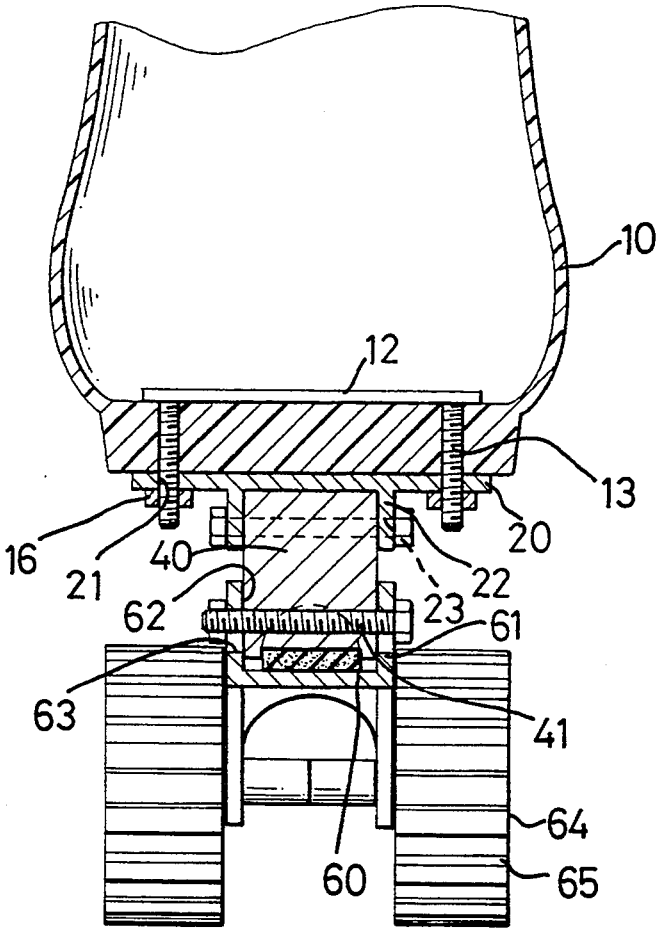
FIG. 3 is a rear view, partly sectioned, of the track/roller skate.
Figure 4:
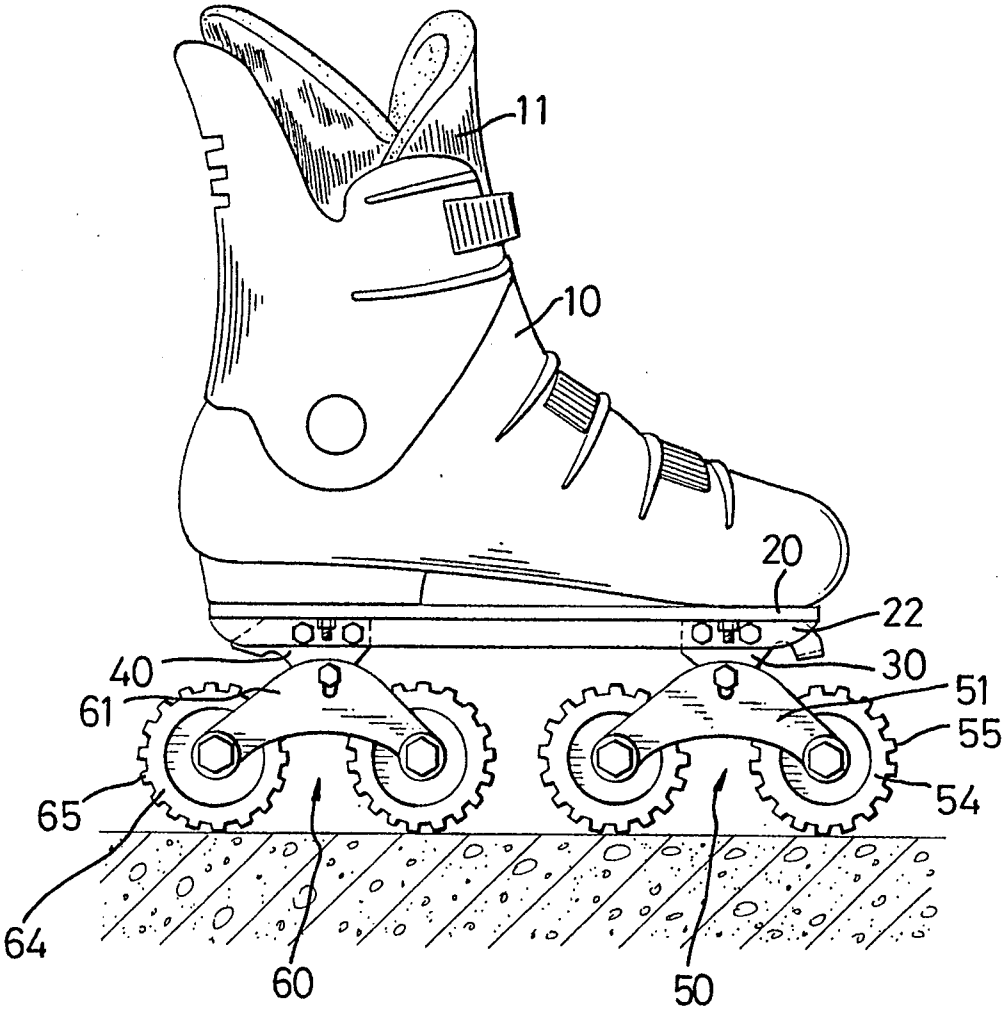
FIG. 4 is a side view of the track/roller skate without tracks.

Further referring to FIG. 3., the plate 20 is removably attached to the underside of the skate boot 10 by a pair of mounting strips 12 each of which has a pair of studs 13 extending outward from one side thereof. The mounting strips 12 are mounted inside the skate boot 10 before the lining 11 of the skate boot 10 is installed, with the studs 13 passing through holes (not labeled) in the skate boot 10 and further through holes 21 in the plate 20 and are then fastened by nuts 16.

The front roller assembly 50 includes a pair of bridge members 51 which together define a receiving compartment 52 for receiving the lower part of a mounting member 30 by means of which the roller assembly 50 is mounted between the mounting ribs 22. A pair of rollers 54 are provided to each of front and rear ends of each bridge member 51 in a manner such that the rollers 54 are aligned in two lines. Each roller 54 includes cone-shaped or rectangular strips in an outer periphery thereof. Each bridge member 51 includes an elongate hole 53 in a mediate section thereof. The mounting member 30 includes a transverse bore 32 in the lower end thereof and a pair of transverse holes 31 in an upper edge thereof. The mounting member 30 is secured in the receiving compartment 52 by bolts passing through aligned bore 32 and holes 53. Thereafter, the mounting member 30 is secured between the mounting ribs 22 by bolts passing through aligned transverse holes 23 and 31. Preferably, a resilient member 56 is mounted inside the receiving compartment 52 to provide a shock absorbing effect. The front roller assembly 50 is identical to the rear roller assembly 60 in structure, while the mounting member 40 for the rear roller assembly 60 is identical to mounting member 30, except that the reference numerals designating corresponding like elements are respectively led by "6" and "4".

It is appreciated that other types of roller assemblies and mounting members can be use as long as the rollers are changed in two lines.

Each track 70 includes external corrugations or tread 71 and internal corrugations or teeth 72 respectively in outer and inner peripheries thereof, the corrugations 72 on the inner periphery having a configuration corresponding to that of corrugations or teeth 55, 65 on the external surface of the rollers 54, 64, allowing smooth rotation therebetween.

By such an arrangement, when the tracks 70 are mounted around the roller lines, the whole device can be used to ski on grass or to skate on ice. When the tracks 70 are removed, the device can be used to skate on ordinary roads or used as snow shoes. The dual-line roller design is particular advantageous for beginners as it provides a stable structure.

Figure 5:
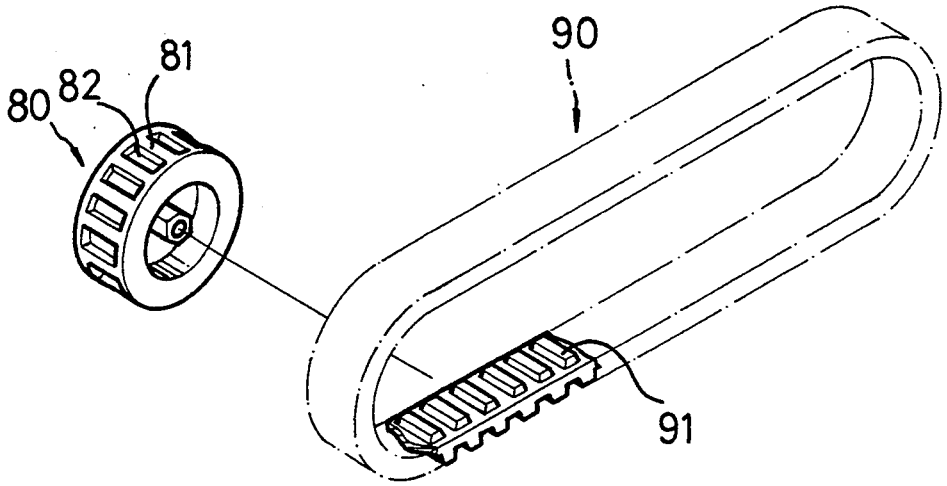
FIG. 5 is a schematic view illustrating another embodiment of the track and the roller.

FIG. 5 illustrates another embodiment of the invention in which the roller 81 of the roller assembly 80 includes a plurality of transverse elongate slots or recesses 82 around its periphery, while the corrugations or projections 91 on the inner periphery of the track 90 are narrowed in width to mate with the elongate slots 82.

Although the invention has been explained in relation to its preferred embodiment, it is to be understood that many other possible modifications and variations can be made without departing from the spirit and scope of the invention as hereinafter claimed.

I claim:

1. A continuous track roller skate comprising: a longitudinally extending upper foot supporting structure defining an underside base; a pair of parallel ribs projecting downwardly from said base and extending longitudinally of said structure; front and rear roller assemblies mounted between said ribs, each assembly including a pair of bridge member having front and rear ends and together defining a compartment therebetween; a resilient shock absorber mounted In each said compartment; a pair of rollers rotatably mounted on each of said front and rear ends of each said bridge member, each of said pair of rollers being aligned with corresponding rollers on each roller assembly to define two arrays of rollers, and each said roller having a plurality of external transverse teeth on an outer periphery thereof; and an externally treaded track removably mounted around each said roller array, said track having a plurality of internal teeth on the inner surface thereof for operative engagement with said roller teeth.

2. A continuous track roller skate comprising: a longitudinally extending upper foot supporting structure defining an underside base; a pair of parallel ribs projecting downwardly from said base and extending longitudinally of said structure; front and rear roller assemblies mounted between said ribs, each assembly including a pair of bridge members having front and rear ends and together defining a compartment therebetween; a resilient shock absorber mounted in each said compartment; a pair of rollers rotatably mounted on each of said front and rear ends of each said bridge member, each of said pair of rollers being aligned with corresponding rollers on each roller assembly to define two arrays of rollers, and each said roller having an external surface defining a plurality of recesses therein; and an externally treaded track removably mounted around each said roller array, said track having a plurality of internal projections on the inner surface thereof for operative engagement in said roller recesses.

* * * * *